US006311599B1

(12) United States Patent
Lindehall

(10) Patent No.: US 6,311,599 B1
(45) Date of Patent: Nov. 6, 2001

(54) VALVE ARRANGEMENT

(75) Inventor: Tomas Lindehall, Umea (SE)

(73) Assignee: Partek Forest AB, Umea (SE)

( * ) Notice: Subject to any disclaimer, the term of this patent is extended or adjusted under 35 U.S.C. 154(b) by 0 days.

(21) Appl. No.: 09/355,884

(22) PCT Filed: Feb. 3, 1998

(86) PCT No.: PCT/SE98/00195

§ 371 Date: Nov. 12, 1999

§ 102(e) Date: Nov. 12, 1999

(87) PCT Pub. No.: WO98/34768

PCT Pub. Date: Aug. 13, 1998

(30) Foreign Application Priority Data

Feb. 6, 1997 (SE) ..... 9700413

(51) Int. Cl.[7] ..... B27B 17/14
(52) U.S. Cl. ..... 83/819; 30/386
(58) Field of Search ..... 83/816, 818, 819; 30/383, 384, 385, 386

(56) References Cited

U.S. PATENT DOCUMENTS 2,316,997 * 4/1943 Smith ..... 83/818
3,279,508 * 10/1966 Ehlen et al. ..... 83/818
4,382,334 * 5/1983 Reynolds ..... 83/816
5,174,029 * 12/1992 Talberg ..... 30/386
5,395,705 3/1995 Leini .
5,533,432 7/1996 Ornberg .
6,032,373 * 5/2000 Peterson ..... 30/386

FOREIGN PATENT DOCUMENTS

467454 B 7/1992 (SE) .

* cited by examiner

*Primary Examiner*—M. Rachuba
(74) *Attorney, Agent, or Firm*—Sanford J. Piltch

(57) ABSTRACT

A valve device including a cylindrically-shaped space and a displaceable piston dimensioned to fit and move between forward and rearward stop positions within the space, having a first opening connection or inlet to the hydraulic system and a second opening connection or outlet to the tightening piston in the space and an openable check valve positioned in the outlet such that the check valve allows fluid to flow only in one direction from the cylindrically-shaped space to a hydraulic tightening piston in a sawing gear for adjusting the tightness of a saw chain. The displaceable piston, with the hydraulic system in a non-pressurized state, is urged by the influence of a tensioned spring to its forward stop position opening the check valve and with the hydraulic system in a pressurized state, is pushed back by the pressure in said cylindrically-shaped space to its rearward position which permits the check valve to close preventing hydraulic fluid from flowing from the hydraulic tightening piston and into the cylindrically-shaped space.

8 Claims, 2 Drawing Sheets

VALVE ARRANGEMENT

BACKGROUND OF THE INVENTION

The present invention concerns a valve arrangement for adjusting a hydraulic saw chain tightening device in sawing gear that includes a holder and a saw bar displaceable in a longitudinal direction relative to the holder for regulating the tightness of a saw chain running around the saw bar and holder, whereby the saw chain tightening device is connected by the valve arrangement to a hydraulic circuit system and includes at least one hydraulic piston affecting the saw bar.

When mechanised means are used to improve the efficiency of logging operations, it is preferable to use what is known as a timber cutting unit comprising a sawing gear that includes a saw chain and a saw bar. Efficient logging puts high demands on the equipment used with regard to safety, robustness, ease-of-use as well as precision and performance, i.e. that the equipment works quickly.

It is well known that a saw chain that rotates under conditions of high speed around a sew bar requires chain tightening at relatively short intervals. In addition, it is also known that the problem of chain tightening can be solved by an automatic and continuous tightening of the saw chain, which is achieved by making the saw bar displaceable in the saw bar's longitudinal direction in relation to the drive gear of the saw chain. However, the chain-tightening force must not be too great, as too great a tension increases the wear on the chain and shortens the working life of both the saw chain itself and of the wheel around which the saw chain runs at the free end of the saw bar.

An attachment for a saw bar of a chain saw is described in SE 467,488. The attachment includes plate with a grooved recess in which a steering part united with the saw bar moves in the saw bar's longitudinal direction. A piston projecting from the recess in the plate in the longitudinal direction of the saw bar bears on the guiding part when in its active operating position. The piston gets its power from a fluid system integrated and enclosed in the plate and that includes a gas-sprung pressure chamber that is connected to the piston by a line and a valve. The valve is a manually switchable check valve, that in one position permits fluid to flow only from the pressure chamber to the piston, thus tightening the chain by displacing the saw bar, and in a second position permits fluid to flow only from the piston to the pressure chamber, which, due to an increase of pressure in the chamber, restores the position of the piston when, for example, replacing the saw chain with a new one.

The technology of an enclosed system carries with it, among other things, the limitation that the pressure at the piston varies depending on the position of the piston. The stretching force is greater when the piston is in its inner position and somewhat less when the piston is in its outer position. Further disadvantages are the problems of having to maintain and/or consciously be able to vary the pressure and thus the stretching force over time.

When a new chain is to be fitted, the check valve is switched and a levering tool is used to force back the piston. A high pressure in the enclosed hydraulic system, which is needed to ensure a sufficiently great stretching force for the saw chain, means that a powerful force is required to push back the piston. This is unsatisfactory, partly because of the working environment and the risk of injury to the user, and partly because loose specialised tools have a tendency to disappear or be difficult to find when they are needed.

SE 502,386 illustrates how a similar piston is arranged, in this case in a steering part permanently attached to the saw bar and accommodated in a groove in the attachment/holder, whereby the piston, when affected by the fluid under pressure, keeps the saw bar in a position displaced from the attachment/holder. In this case, the piston receives its power from a hydraulic system on the mechanical equipment on which the sawing gear is mounted. An additional pair of pistons are also found on the same hydraulic system arranged to stabilise the saw bar by means of a clamping action across the direction of displacement of the saw bar. The saw bar is thus affected partly by a piston arranged to push the blade from the holder so that the saw chain is kept tight, and partly by at least one clamping piston that holds the blade tightly and stabilises it in position. The force keeping the chain tight is somewhat greater than the force of friction that results from the clamping pistons so that a continuous tightening is achieved while the chain still displays a relatively stable attachment. All the pistons are connected to the machinery's hydraulic system and when this equipment is in operation, the pistons are provided with what is essentially a constant pressure.

A check valve is also arranged in the line from the hydraulic system. This check valve is essential to ensure that the saw chain does not become slack during operation. This could happen as a result of the rapid loading and pressure increases that occur at the piston, for example, at start-up when the saw chain goes from stationary position to full speed in a very short time, or when a saw chain moving a high speed is forced against a tree trunk or when a branch gets caught in the chain, etc.

When a saw chain is to be replaced, the pistons must be forced back, which means that the hydraulic fluid behind the pistons must be disposed of. In devices similar to that described in SE 502,386, this is done as follows. Firstly, the machinery is stopped so that the hydraulic system loses its pressure. The check valve, however, ensures that the pressure is maintained behind the piston(s), which is why chain replacement calls for emptying to ease the pressure. In practice, emptying requires that the operator needs to have a special tool at hand to open the evacuating valve that is normally located on the sawing gear. As a collection vessel for the fluid is usually not available, this evacuation means an unwanted oil spill in a natural environment. In addition, evacuation also brings the risk that air may enter the hydraulic system, which if it happens, will greatly diminish the sought after rigid tightening and stabilising function of the pistons.

SUMMARY OF THE INVENTION

One object of the present invention is to overcome the disadvantages mentioned above and to achieve a valve device that functions as a check valve when the hydraulic system is pressurised, and that automatically evacuates the pressure without fluid spillage when the hydraulic system is not pressurised, thereby making it possible to replace a saw chain without the need for any special tool.

This objective is achieved with a valve device of a kind first mentioned above and which has those features evident from the characteristics of attached claim 1.

We propose, therefore, a valve device that, when the equipment is in operation and the hydraulic system pressurized, is by means of this pressure in a condition that renders it able to function as a check valve that allows the fluid to flow in a direction towards the piston(s), and, when the equipment is shut down and the hydraulic system is accordingly unpressurised, is by means of the absence of this pressure, in a condition that allows the fluid to flow back from the piston(s).

Further characteristics and advantages of the invention will become evident from the subsequent claims and from the following detailed description of the preferred embodiments of the invention, which constitutes one example and as such does not limit the extent of the protection for the invention.

BRIEF DESCRIPTION OF THE DRAWINGS

To simplify the understanding, the text contains references to enclosed drawings of figures, in which equivalent or similar parts have been assigned the same referenced designation.

DETAILED DESCRIPTION OF THE INVENTION

The valve device according to the invention can either be arranged in its own stand-alone valve housing or it can be wholly or partially integrated in another component of the hydraulic system or sawing gear to which the valve device is connected. In the embodiments described here, the valve device is integrated in a holder for the displaceable saw bar that is included in the sawing gear.

Figure 1:
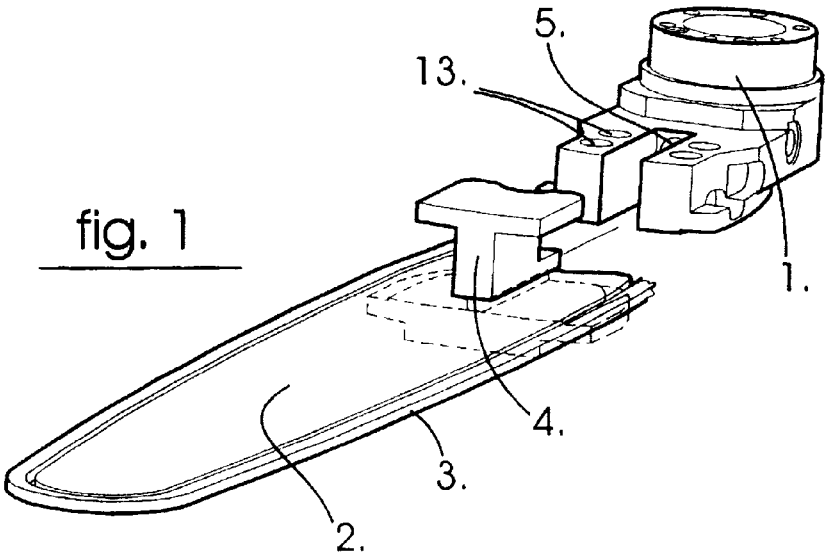
FIG. 1 shows schematically a sawing gear with constituent parts.
Figure 2:
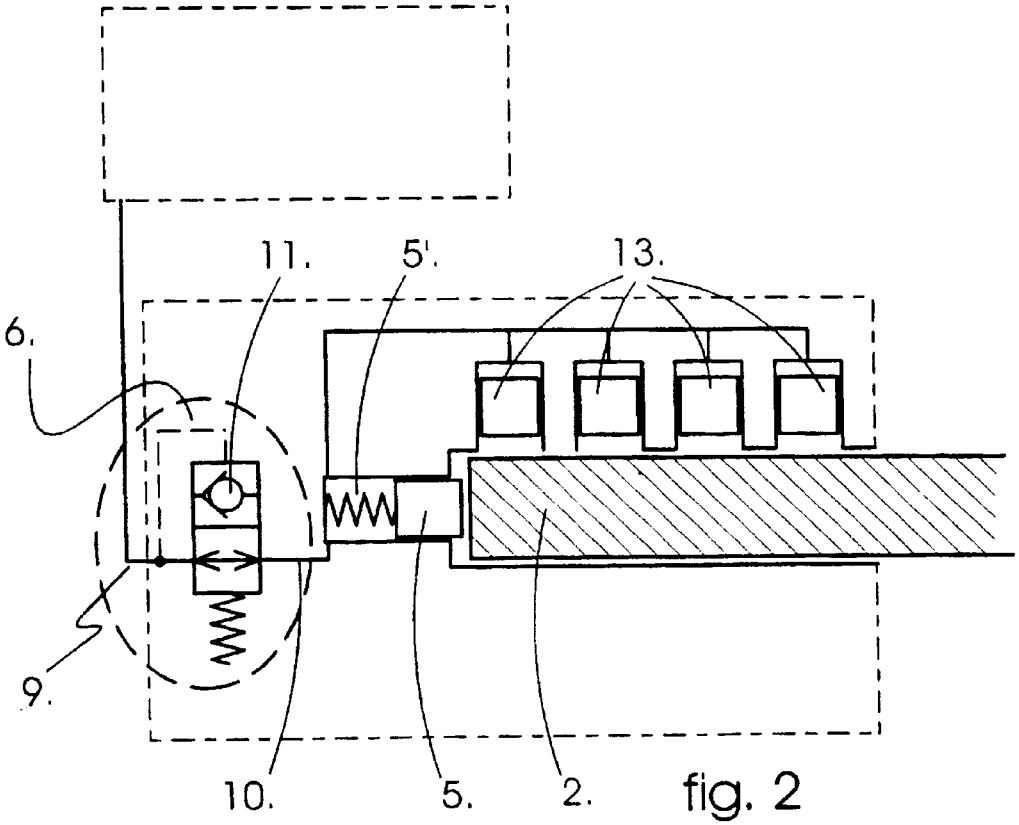
FIG. 2 shows the arrangement of a hydraulic coupling according to one embodiment of the present invention.

FIG. 1 is a schematic illustration of sawing gear containing a holder 1, from which extend two parallel forks. The forks delineate a groove or a space between them intended to be taken up by a steering component 4 permanently attached to the saw bar 2. The steering component 4 has an essentially T-shaped cross-sectional profile and, together with the saw bar, forms what is essentially an H-shaped end piece whose narrow middle section is intended to occupy the groove between the forks. This accomplishes a connection of the saw bar to the holder that is displaceable in the direction of travel of the saw bar.

The displacement thus allows the tightness of a saw chain 3 running around the saw bar to be adjusted. The displacement is accomplished by means of a device that stretches the saw chain by acting between the holder and the saw bar. In the present embodiment, the chain stretching device includes a hydraulic piston 5 arranged in the holder 1 and active in the direction of the displacement of the saw bar. This hydraulic piston is referred to below as the tightening piston. The tightening piston 5 is arranged in the groove and applies a force against the saw bar's steering component 4 when the tightening piston is subjected to hydraulic pressure, at which it has the effect of displacing the saw bar in the direction away from the holder, where, in fact, the driving wheel of the saw chain is arranged.

The tightening piston receives its pressure setting from the hydraulic system, by which a continuous and even stretching of the saw chain is accomplished.

Figure 3:
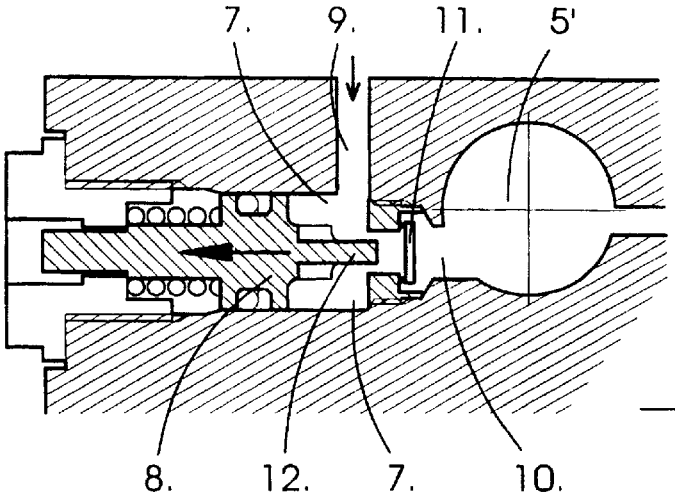
FIGS. 3 and 4 show a section of the holder according to FIG. 1 including a valve device according to one embodiment of the present invention in its working position and resting position respectively.
Figure 4:
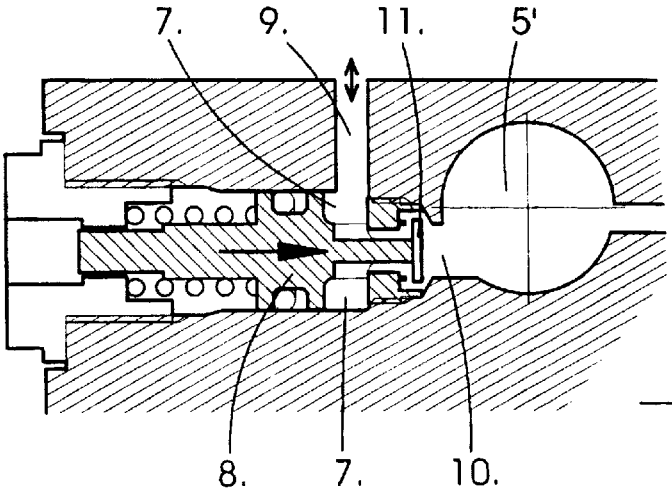
Figure 5:
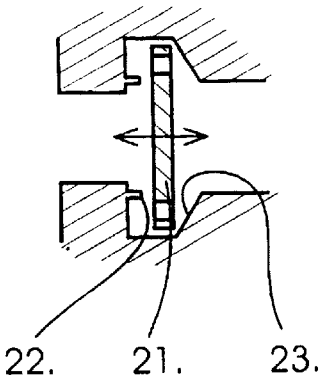
FIG. 5 shows a check valve device according to one embodiment of the present invention.

Our valve device 6 according to the invention is arranged connected to the tightening piston 5 and, in the present embodiment, includes a cylindrical space 7 and a displaceable piston device 8 that is adapted to fit and move in the space, see FIGS. 3 and 4. Space 7 has openings in front of piston device 8; one is for connection/line 9 of the hydraulic system, referred to below as the inlet, and another is the connection 10 to the tightening piston 5, referred to below as the outlet.

Outlet 10 is arranged with a check valve function, for example, in the form of a flap 11 that is moveable between an open position (see FIG. 4) that allows hydraulic fluid to flow freely between the outlet 10 and the inlet 9, and an active check valve position (see FIG. 3) that allows hydraulic fluid to flow in the direction from inlet 9 through outlet 10 to apply pressure to the chamber 5' behind the tightening piston 5 but which prevents liquid to flow in the opposite direction.

In the space, piston device 8 is under tension from a spring in the direction towards the openings and has an extended projection 12 in the forward direction. When the hydraulic system is not pressurised, the flap device 11 comes under the influence of the extended projection 12 of the spring piston, by which the projection 12 causes the flap to take up its open position.

When the hydraulic system is pressurised, the hydraulic pressure increases simultaneously in space 7 and chamber 5' behind the tightening piston 5 since the hydraulic fluid can flow freely through outlet 10. The increasing pressure causes piston device 8 in the space to be displaced in a backwards direction against the tension of the spring and thus withdraw projection 12 from flap 11, which is then allowed to take up its active check valve position still permitting a pressure-increasing flow of fluid through outlet 10.

If, during work, a powerful load should occur to push the saw bar back towards the holder, i.e. if a forceful increase in pressure occurs in chamber 5' external to flap 11 in relation to the pressure in space 7, flap 11 will prevent the release of fluid through outlet 10 into space 7. In this way, the saw chain retains its tension despite momentary peak loads.

When a saw chain 3 is to be fitted, the hydraulic system is de-pressurised by, for example, switching off the machine that powers the hydraulic system and that may also support the sawing gear. The pressure in chamber 7 falls and eventually reaches a level that can be overcome by the pro-sprung piston device, whose extended projection 12 then applies a force to flap 11 that opens the check valve so that the pressure behind outlet 10 is released when the fluid is once again allowed to flow back through the outlet and into chamber 7. In this way, the saw bar can be pressed back into the holder by hand and a new chain fitted or an old one removed without the need for any great exertion or special tools.

The holder also includes clamping piston devices 13 arranged across the direction of travel of the saw bar and that are also connected to a hydraulic system, preferably the same hydraulic system as the tightening piston. The clamping piston devices 13 must also be released when the saw chain is to be replaced. It is thus advantageous if even these can be equipped with a valve device according to the present invention, which in the present embodiment is preferably connected to the same valve device as the tightening piston. This can be achieved, for example, by channels in the holder between the different pistons 5 and 13.

With this latter arrangement of connections, the system can be balanced, for example, by means of flow reducing restrictions in the different lines that connect the pistons. In this way, for example, a pre-determined flow restriction in the flow channel connections to clamping pistons 13 can be accomplished by the tightening piston 5 tightening the saw chain before the hydraulic pressure presses the clamp pistons 13 to its full extent.

In the present embodiment, space 7 consists of a hole bored in holder 1. The hole is threaded to a pre-determined depth so that a screw or a plug can be used to close-off the hole.

Piston device 8 displays a cylindrical part that is adapted to the side walls of the hole. To ensure the tightness between the piston and the wall, at least one groove is also arranged around the piston's cylindrical section for a seal, e.g. an O-ring or piston ring or similar. The said projection 12 for opening the check valve is located at the front of the piston device. This projection should be designed so that it does not hinder the fluid from flowing past when it projects forward and opens the check valve. The projection 12 should, therefore, have a cross-section that is significantly less than the diameter of the hole and that is less than, or at least equal to, the opening it creates by opening the check valve. When piston 8 is in position in the hole, a spring of suitable type, e.g. a spiral spring, is inserted before the screw is threaded into the hole to close off the valve device.

In the present embodiment, the flap device 11 contains a plate-like flap 21 that moves between two stop positions 22 and 23. In the first stop position 22, flap 21 bears on and seals off the flow path from outlet 10 to space 7. In the second stop position 23, the flap bears on outlet path 23 during the build-up of open passages for the flow through of fluid. These openings, through which fluid can flow in the second position, can, for example, be made in the actual flap to the side of that part of the flap surface that closes off the flowpath, or the flap's forward limitations 23 can be made shoulder-like to leave a gap between where the fluid can flow when the flap lies against them, or by some other solution applicable for the flaps. The flap device can also contain a flap that is arranged to swing at a wall in outlet 10.

It should also be realised that other types of check valve that in a similar manner can be opened by the external influence of the piston device, such as spring loaded ball valves, etc., should be interpreted as being equivalent to the flap device described here. The flap device in the embodiment described above has the advantage of occupying a small space, which means that the physical distance between the tightening piston's pressure space 5' and space 7 can be kept short. In this way, an exceptionally compact solution is achieved.

In addition, the flap device can be arranged with a light spring that ensures that the flap takes up a check valve location bearing on stop position 22 when not under the influence of an external pressure.

Furthermore, it should also be realised that the said cylindrical space 7 and the piston device 8 that is accordingly designed to fit and move in that space do not necessarily need to have a circular cross-section, but can have other shapes that are also suitable for the current application, such as oval, rectangular, etc.

Figure 6:
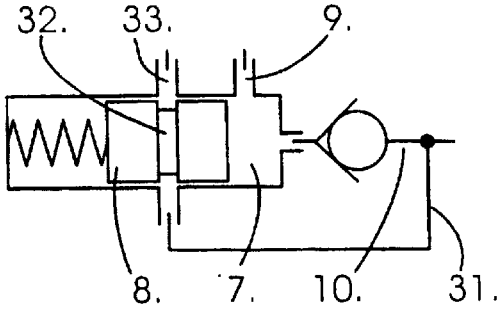
FIGS. 6 and 7 show a section of the holder according to FIG. 1 including a valve device according to an alternative embodiment of the present invention in its working position and resting position respectively.
Figure 7:
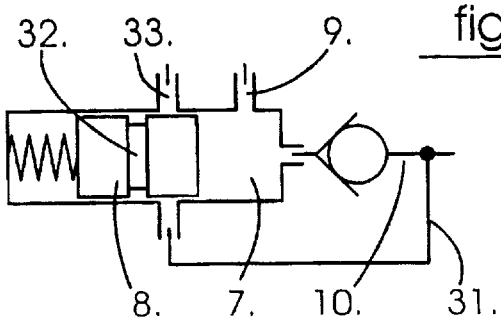

In an alternative embodiment shown schematically in FIGS. 6 and 7, this piston device's adjustment of the returning fluid can be arranged in another manner. In this case, a return flow passage 31 has been arranged from a location behind the check valve, which here can be any check valve known to a specialised skilled person, to the cylindrically shaped space. The return flow passage opens into the cylindrically shaped space in a position that, with the piston device in its rear location (see FIG. 7) is closed-off by the piston device's wall, and which, with the piston device in its forward location (see FIG. 6), is situated opposite to a through flow passage 32 running through the piston device and further on to a line 33 that either is connected to the pressure line 9 of the hydraulic system, a pressure-free return line direct to a tank, to a separate tank, directly out into the surroundings, or to another suitable place.

What is claimed is:

1. A valve device for automatic adjustment of the fluid pressure to a hydraulic tightening piston is a sawing gear between a holder and a saw bar displaceable in a longitudinal direction relative to the holder for adjusting the tightness of a saw chain running around the saw bar and a wheel positioned on the holder, the tightening piston being connected to a hydraulic system via the valve device, the valve device includes a cylindrically-shaped space and a displaceable piston dimensioned to fit and move between forward and rearward stop positions within the space, the improvement characterized in that the space in front of the piston has first and second opening connections, said first opening connection or inlet to the hydraulic system and said second opening connection or outlet to the tightening piston, an openable check valve being positioned in the outlet such that said check valve allows fluid to flow only in one direction from the cylindrically-shaped space to the tightening piston, the displaceable piston being under tension by a spring and urged in a forward direction towards the outlet and the forward stop position causing the check valve to move to an open position, whereby the displaceable position, when the hydraulic system is in a non-pressurized state, is caused by the influence of the spring to its forward stop position opening the check valve, and when the hydraulic system is in a pressurized state, is pushed back by the pressure in said cylindrically-shaped space to its rearward position which permits the check valve to close preventing hydraulic fluid from flowing from the tightening piston and into the cylindrically-shaped space.

2. The valve device according to claim 1, wherein the valve device is positioned in the holder.

3. The valve device according to claim 1, wherein the outlet is connected partly to the tightening piston and partly to several saw bar-stabilizing clamping pistons positioned in the holder to adjust the saw bar.

4. The valve device according to claim 1, wherein the check valve has a circular flap with a rear stop position and a forward stop position, whereby the flap is configured to seal tightly against the rear stop position when subjected to an over-pressure or a jolt of pressure from the tightening piston, and when pressed against the forward stop position permits fluid to flow between the tightening piston and the cylindrically-shaped space.

5. The valve device according to claim 1, wherein the check valve positioned in the outlet is positioned between the cylindrically-shaped space and the tightening piston, and positioned symmetrically with regard to the central axis of the cylindrically-shaped space.

6. The valve device according to claim 5, wherein the opening to the inlet is disposed in a side wall of the cylindrically-shaped space.

7. The valve device according to claim 1, wherein the displaceable piston includes a projection extending in a direction pointing towards the check valve, a pressure spring behind the displaceable piston, and a seal between the displaceable piston and the wall of the cylindrically-shaped space through which the projection, when the displaceable piston is in its forward stop position, forces the check valve into its open position to allow free flow of fluid.

8. The valve device according to claim 1, wherein a return flow passage extends from a location between the check valve and the tightening piston to the cylindrically-shaped space where the return flow passage opens in the wall of the cylindrically-shaped space and that, with the displaceable piston in its rearward stop position, is closed-off by the piston wall, and which, with the displaceable piston in its forward stop position, opens opposite to a through-flow passage running through the piston and further to a line that is connected to the hydraulic system.

* * * * *